US009676449B1

(12) United States Patent
Syryda

(10) Patent No.: US 9,676,449 B1
(45) Date of Patent: Jun. 13, 2017

(54) CONVERTIBLE BOAT HULL

(71) Applicant: Brendon Avery Syryda, Kelowna (CA)

(72) Inventor: Brendon Avery Syryda, Kelowna (CA)

( * ) Notice: Subject to any disclaimer, the term of this patent is extended or adjusted under 35 U.S.C. 154(b) by 0 days.

(21) Appl. No.: 15/214,281

(22) Filed: Jul. 19, 2016

(51) Int. Cl.
*B63B 1/14* (2006.01)

(52) U.S. Cl.
CPC ..... *B63B 1/14* (2013.01); *B63B 2001/145* (2013.01)

(58) Field of Classification Search
CPC ..... B63B 1/14
USPC ..... 114/61.18
See application file for complete search history.

(56) References Cited

U.S. PATENT DOCUMENTS

| | | | | |
|---|---|---|---|---|
| 3,559,222 | A * | 2/1971 | Walker | B63B 1/22 114/287 |
| 4,494,477 | A | 1/1985 | Matthews | |
| 4,993,340 | A | 2/1991 | Pepper | |
| 5,943,978 | A | 8/1999 | Garnier | |
| 6,223,674 | B1 * | 5/2001 | Wyman | B63B 39/005 114/271 |
| 6,223,677 | B1 | 5/2001 | Hall | |
| 6,619,224 | B1 * | 9/2003 | Syfritt | B63B 1/04 114/284 |
| 6,877,450 | B2 * | 4/2005 | Schmidt | B63B 1/04 114/61.13 |
| 7,194,972 | B2 * | 3/2007 | Schmitz, Sr. | B63B 1/10 114/61.1 |
| 7,634,971 | B2 * | 12/2009 | Lucas | B63B 1/08 114/61.15 |
| 8,132,524 | B2 | 3/2012 | Pereira | |
| 8,166,903 | B1 | 5/2012 | Demmelmaier | |
| 9,114,853 | B1 | 8/2015 | Apple | |
| 9,334,021 | B1 * | 5/2016 | Fielding | B63B 1/107 |
| 2008/0196648 | A1 * | 8/2008 | Thompson | B63B 1/121 114/61.18 |
| 2012/0024211 | A1 * | 2/2012 | Wiltse | B63B 1/14 114/39.21 |

* cited by examiner

*Primary Examiner* — Lars A Olson
*Assistant Examiner* — Jovon Hayes
(74) *Attorney, Agent, or Firm* — Integrity Patent Group, PLC; Edwin Wold

(57) ABSTRACT

A boat hull comprises a central hull having top and bottom portions and first and second side hulls slidably supported from the top portion of the central hull so as to be transversely extendable relative thereto. The bottom portion of the central hull is rotatably connected to the top portion so as to be movable between raised and lowered positions. A method of reconfiguring the boat hull comprises slidably displacing first and second side hulls relative to a central hull and rotatably displacing a bottom portion of the central hull relative to a top portion from a raised position to a lowered position between the first and second side hulls.

15 Claims, 5 Drawing Sheets

CONVERTIBLE BOAT HULL

BACKGROUND OF THE INVENTION

1. Field of Invention

The present invention relates generally to boats and in particular to boats that may be converted into multiple hull configurations.

2. Description of Related Art

Recreational boats are available with a variety of hull configurations. Each configuration has benefits for different uses and conditions. In particular, shallow multihull boats have great stability, particularly at low speeds and at rest. These boats are desirable for fishing or cruising on calm waters, are well suited for coaching of various watersports due to their low wake, and can also achieve high speeds with relatively low wake. Water skiers prefer low wake to enable carving of turns, thus a shallow multihull boat is desirable for this sport.

Deep vee bottomed boat hulls are advantageous at high speeds and in rough water conditions. They can also create a significant amount of wake, which is desirable for wakeboarding. At lower speeds this design has less stability, and is therefore less desirable for low speed or at rest recreational uses, such as fishing, low speed cruising or resting at anchor.

Both deep vee bottom and shallow multihull boats have advantages. Rather than utilize multiple boats to meet the needs of all water sport enthusiasts, boats with convertible boat hulls allowing multiple hull profiles are desirable. Previous attempts have been made to allow conversion between two different hull shapes, however such attempts have not been satisfactory.

Some previous convertible boat hull attempts have included designs which modify the shape of a single hull, but do not include multiple hulls. Examples of such are U.S. Pat. No. 6,223,674 B1 to Wyman et al. and U.S. Pat. No. 3,559,222 to Walker.

Other attempts have included the ability to adjust the configuration of multiple hulls, such as described in U.S. Pat. No. 2012/0024211 A1, Wiltse, but stabilizers remain present in all configurations. Additionally, the movement of the pontoons or stabilizers in such designs is largely vertical and does not affect the overall width of the boat.

The configuration illustrated in U.S. Pat. No. 6,619,224 B1, Syfritt, similarly does not significantly affect the overall width of the boat between the two configurations. Additionally, this design includes only one bow.

SUMMARY OF THE INVENTION

According to a first embodiment of the present invention there is disclosed a boat hull comprising a central hull having top and bottom portions and first and second side hulls slidably supported from the top portion of the central hull so as to be transversely extendable relative thereto. The bottom portion of the central hull is rotatably connected to the top portion so as to be movable between raised and lowered positions.

The first and second side hulls may be positioned outside the bottom portion of the central hull at the lowered position. The bottom portion of the central hull may be nested within the first and second side hulls at the raised position. The boat hull may further comprise at least one actuator for extending the first and second side hulls relative to the central hull.

The bottom portion of the central hull may be rotatable relative to the top portion about an axis. The axis may be horizontal. The axis may be located proximate to a leading edge of the bottom portion. The bottom portion may have an angular orientation relative to horizontal greater at the lowered position than at the raised position.

The boat hull may further comprise an actuator for extending the bottom portion between the raised and lowered positions. The bottom portion may be abuttable against and alignable with the first and second side hulls such that a bottom running surface of the bottom portion is continuous with corresponding bottom running surfaces of the side hulls at the lowered position. The bottom portion of the central hull may be positionable at an intermediate position between the raised and lowered positions. The bottom portion may be abuttable against and alignable with the first and second side hulls at the intermediate position so as to form a continuous bottom running surface therebetween. The boat hull may further comprise a motor and drive assembly supported on the bottom portion of the central hull.

According to a further embodiment of the present invention there is disclosed a method of reconfiguring a boat hull comprising providing a central hull having top and bottom portions and providing first and second side hulls slidably supported from the top portion of the central hull so as to be transversely extendable relative thereto. The bottom portion of the central hull is rotatably connected to the top portion so as to be movable between raised and lowered positions.

According to a further embodiment of the present invention there is disclosed a method of reconfiguring a boat hull comprising slidably displacing first and second side hulls relative to a central hull and rotatably displacing a bottom portion of the central hull relative to a top portion from a raised position to a lowered position between the first and second side hulls.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
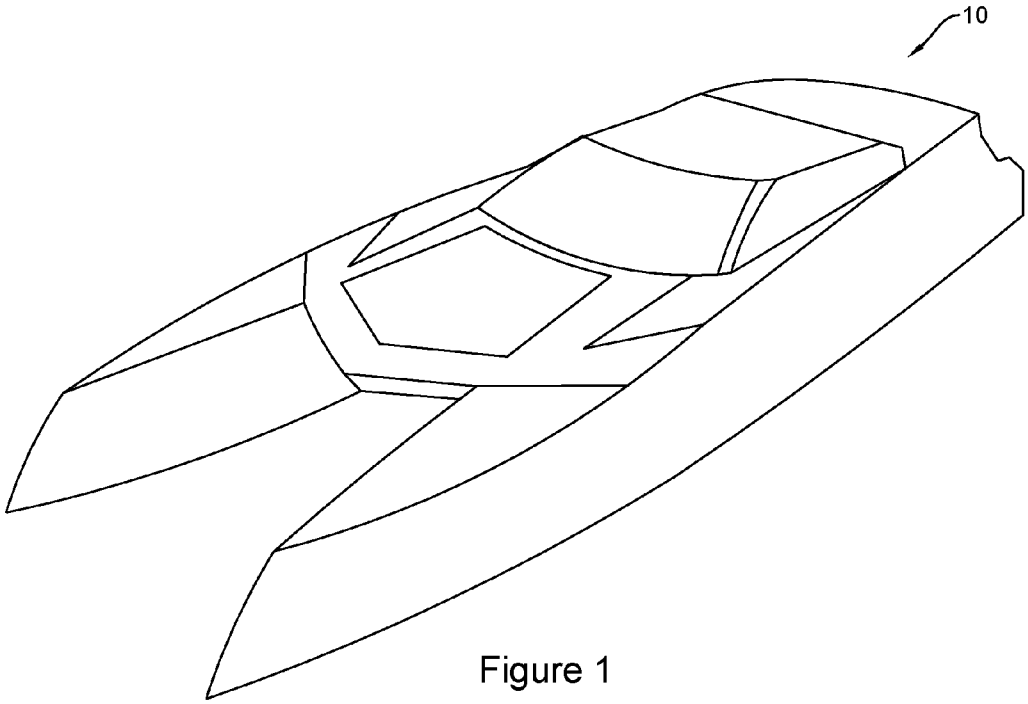
FIG. 1 is a diagrammatic perspective view of a marine vessel with a convertible hull.
Figure 4:
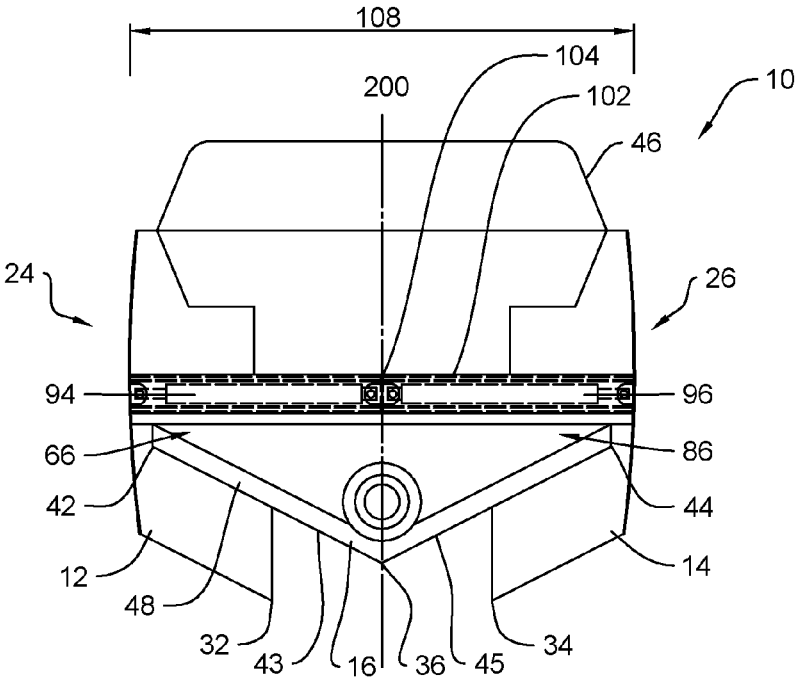
FIG. 4 is an aft view of the marine vessel of FIG. 1, in the first hull configuration.
Figure 5:
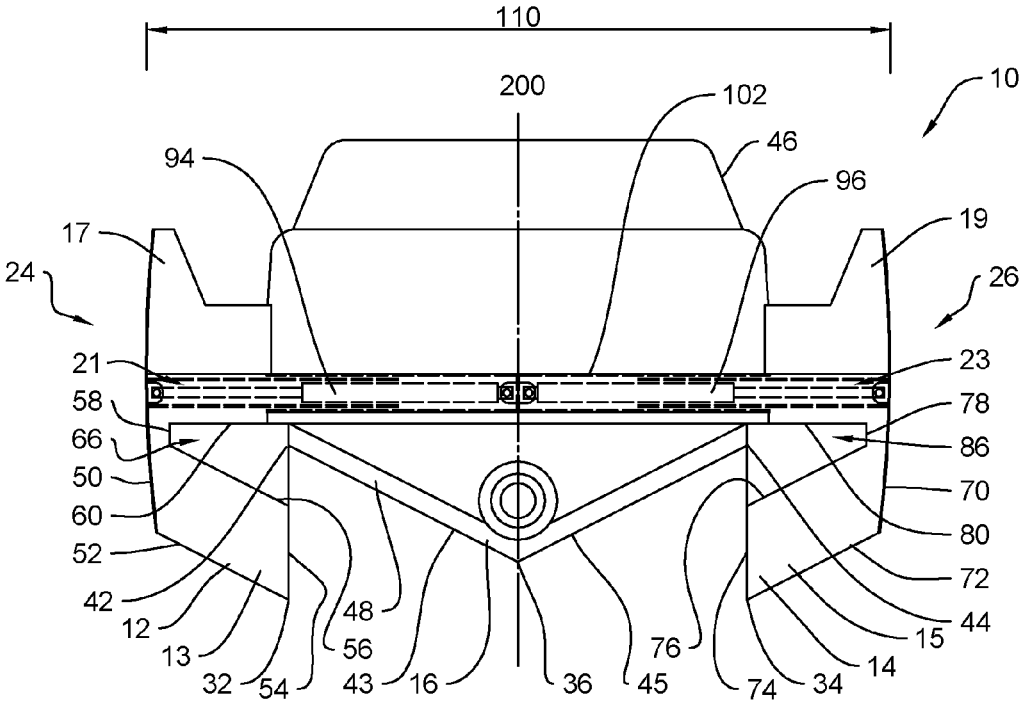
FIG. 5 is an aft view of the marine vessel of FIG. 1, in a second or wide beam shallow hull configuration.
Figure 6:
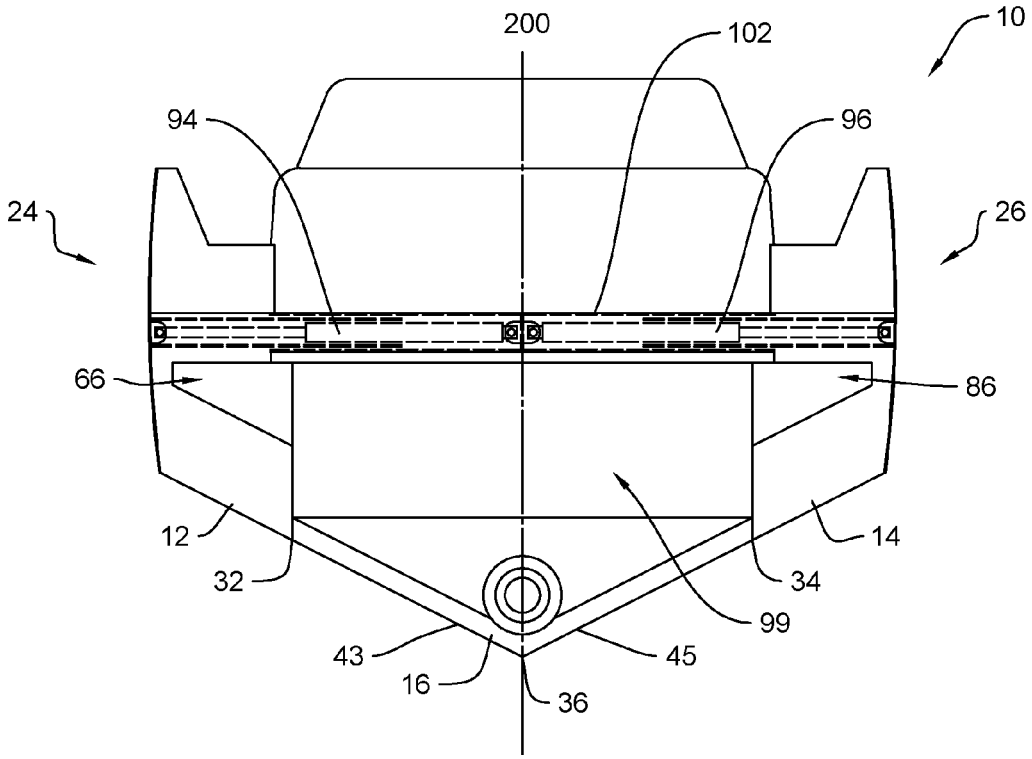
FIG. 6 is an aft view of the marine vessel of FIG. 1, in a third hull configuration.

Referring to FIG. 1, a multihull marine vessel with a convertible hull according to a first embodiment of the invention is shown generally at 10. As best seen in FIGS. 4, 5 and 6, the marine vessel 10 comprises a plurality of hulls, including first and second side hulls 12 and 14, respectively, and a central hull 16 therebetween. As will be described in more detail below, the first and second side hulls 12 and 14 can be adjusted in lateral position, and the central hull 16 can be adjusted in vertical position, thereby altering the overall hull configuration of the marine vessel 10.

Figure 7:
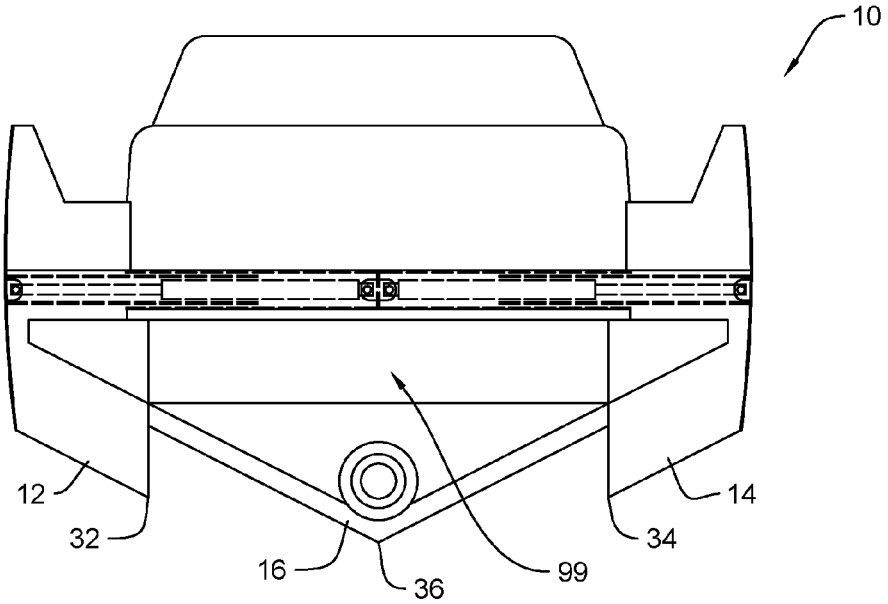
FIG. 7 is an aft view of the marine vessel of FIG. 1, in a fourth or mid-level vee hull configuration.
Figure 8:
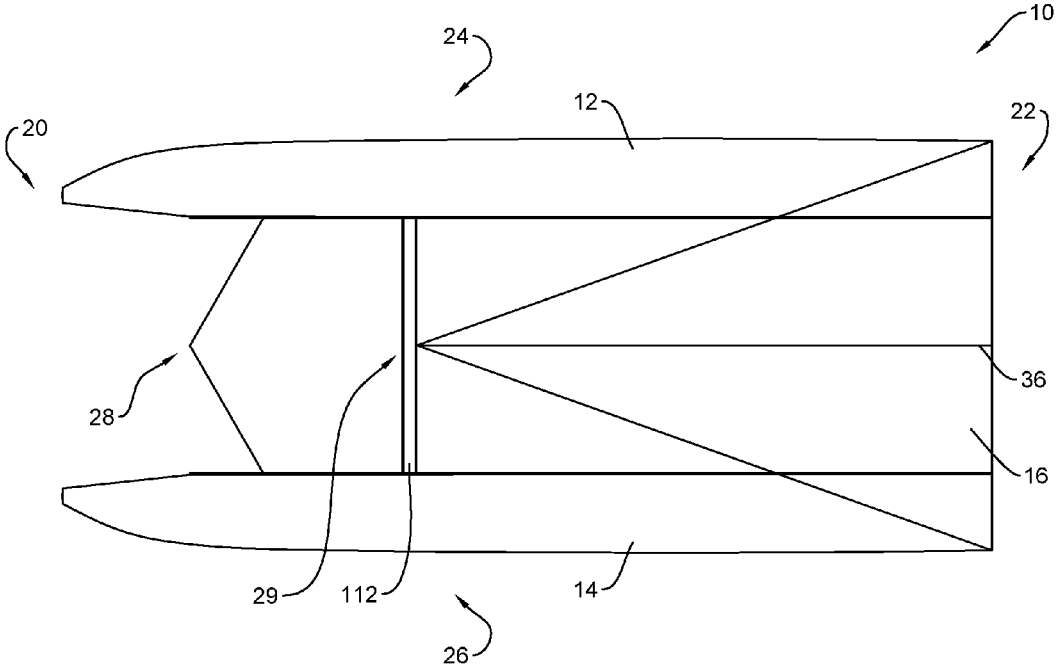
FIG. 8 is a bottom view of the marine vessel of FIG. 1 in a third hull configuration.

Turning to FIG. 8, the marine vessel 10 has fore end indicated at 20, aft end indicated at 22, first or port side 24 and second or starboard side 26. The first and second side hulls 12 and 14, having first and second side hull keels 32 and 34, respectively, as shown on FIGS. 4-7, are positioned proximate to first and second sides 24 and 26, respectively, and extend substantially from fore end 20 to aft end 22. The central hull 16, having central hull keel 36, as shown on FIGS. 4-7, extends substantially from central hull front end 28 to aft end 22, and is positioned centrally between first and second side hulls 12 and 14. The central hull 16 includes a motor and drive assembly 18 therein. As illustrated in FIGS. 1 and 8, the central hull front end 28 may be positioned rearwardly of the fore end 20 of the vessel.

When in the first or second positions, as shown in FIGS. 4 and 5, the exterior of the hull has a generally trimaran shape, with the first and second side hulls 12 and 14 being generally the same shape and size, and the central hull 16 formed in a vee shape therebetween. The central hull 16 extends between first and second sides, 42 and 44, and includes a central hull top portion 46 and central hull bottom portion 48, respectively, wherein the central hull bottom portion 48 extends to a central keel 36. The central hull 16 is shallower than the first and second side hulls throughout its length, from central hull front end 28 to aft end 22, with the central hull keel 36 substantially parallel to the first and second side hull keels 32 and 34. The central hull keel 36 extends substantially from the central hull keel front end 29 to aft end 22. As illustrated, the bottom surface of the central hull bottom portion 48 is formed of first and second central running surfaces, 43 and 45, respectively, extending from the keel 36 as is commonly known. The first and second central running surfaces 43 and 45 are angled relative to horizontal at a deadrise angle, as is commonly known.

As best shown on FIGS. 5 and 6, the first side hull has lower portion 13, upper portion 17 and a first side hull actuating cavity 21 therebetween. Similarly, the second side hull has lower portion 15, upper portion 19 and a second side hull actuating cavity 23 therebetween. The lower portions 13 and 15 of the first and second side hulls, 12 and 14, respectively, are essentially oblique prisms in shape at the aft end of the vessel, although it may be appreciated that they may be another shape throughout the remainder of the length. The first side hull 12 lower portion 13 has outside surface 50, first outside running surface 52, inside lower side surface 54, inside lower top surface 56, inside upper side surface 58 and inside upper bottom surface 60. The inside lower top surface 56 and inside upper side surface 58 form a cavity 66 sized to receive the central hull bottom portion 48 therein. The second side hull 14 lower portion 15 has outside surface 70, second outside running surface 72, inside lower side surface 74, inside lower top surface 76, inside upper side surface 78 and inside upper bottom surface 80. The inside lower top surface 76 and inside upper side surface 78 form a cavity 86 sized to receive the central hull bottom portion 48 therein. The first and second side hulls, 12 and 14, are identical in shape, mirrored along centreline 200.

In the first position, as shown on FIG. 4, the top of the bottom portion 48 of the central hull first and second sides, 42 and 44, are arranged proximate to each other with the central hull bottom portion 48 nested within the cavities 66 and 86, respectively. In this position, the marine vessel 10 has a narrow beam width 108. The first position is beneficial for transporting the marine vessel 10 on a trailer outside of the water.

Figure 2:
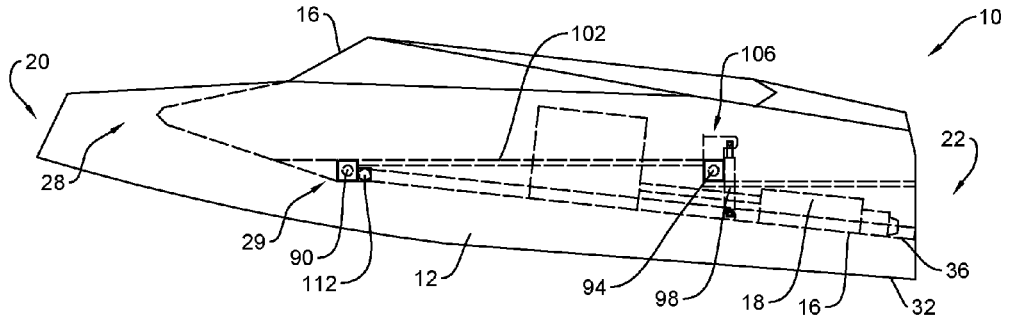
FIG. 2 is a side view of the marine vessel of FIG. 1, in a first or shallow hull configuration.
Figure 3:
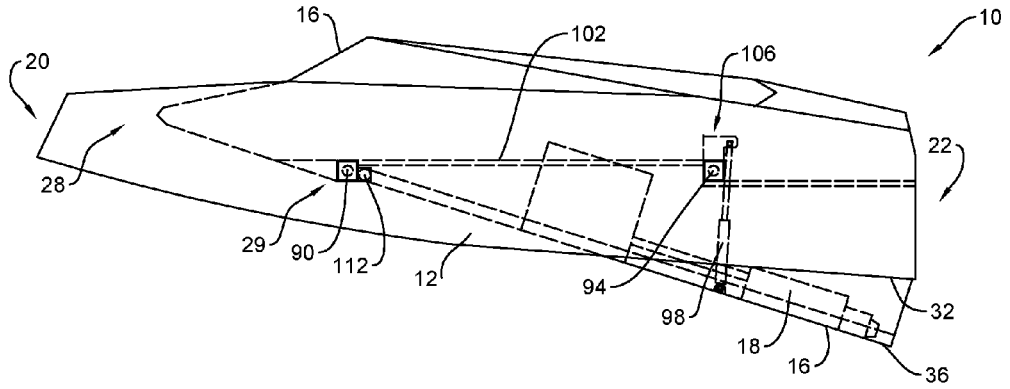
FIG. 3 is a side view of the marine vessel of FIG. 1, in a third or deep vee hull configuration.

Turning to FIGS. 4, 5 and 6, the floor 102 is formed with the central hull top portion 46 and is positioned within the first and second side hull actuating cavities 21 and 23. The floor 102 comprises a box shape with actuators enclosed therein lengthwise extending substantially from central hull keel front end 29 to floor rear end 106, and having a width close to a narrow beam width 108 of the marine vessel 10, extending from first side 24 to second side 26 as shown in the first position in FIG. 4. As best seen in FIGS. 2 and 3, two front lateral actuators, first side front lateral actuator 90 and second side front lateral actuator 92 (not shown), are located at the front of the floor 102, proximate to central hull keel front end 29. Two rear lateral actuators, first side rear lateral actuator 94 and second side rear lateral actuator 96, are located at the rear of the floor 102 proximate to the floor rear end 106. The first side front and rear lateral actuators 90 and 94 are fixed at their first ends to the first side hull 12 and extend from first side 24 to a fixed upright wall 104 within the floor 102 at the centreline 200, to which the second ends of the lateral actuators 90 and 94 are fixed. The second side front and rear lateral actuators 92 and 96 are fixed at their first ends to the second side hull 14 and extend from the second side 26 to a fixed upright wall 104 within the floor 102 at centreline 200, to which the second ends of the lateral actuators 92 and 96 are fixed. The lateral actuators 90, 92, 94 and 96 may be selected to be linear actuators such as, by way of non-limiting example, hydraulic, pneumatic or mechanical screw jack, although it will be appreciated that other actuator types may be useful, as well.

To convert from the first shallow hull position, as shown in FIG. 4, to the second shallow hull position, as shown in FIG. 5, the lateral actuators 90, 92, 94 and 96 are extended simultaneously. As the lateral actuators 90, 92, 94, and 96 extend, the first and second side hulls 12 and 14 slide laterally outwards, increasing the beam width until it reaches a maximum beam width 110. The floor 102 slides substantially out of the first and second side hull actuating cavities 21 and 23, exposing most of the top of the floor surface. A small portion on each side of the floor remains within the actuating cavities, 21 and 23, below the upper portions 17 and 19 of the first and second side hulls 12 and 14.

FIGS. 3 and 6 illustrate the third or deep vee hull configuration of the marine vessel 10. As best seen in FIGS. 2 and 3, a pivot hinge 112 pivotally connects the central hull top portion 46 to the bottom portion 48 at a location proximate to the central hull keel front end 29. As illustrated in FIG. 2, a vertical actuator 98 extends from the compressed first position, and FIG. 3 shows the vertical actuator 98 in the extended second position. The vertical actuator 98 is located proximate to the floor rear end 106 and the upper end is fixed to the floor 102 by any known means, such as, by way of non-limiting example, to a bracket attached by, such as, by way of non-limiting example, weld, bolts or rivets, although other attachment methods may be useful, as well. The lower end of the vertical actuator 98 is fixed to the central hull 16. Although one vertical actuator 98 is illustrated in the present embodiment of the invention, it may be appreciated that additional vertical actuators may be useful, as well, so as to permit placement proximate to each side of the central hull bottom portion 48. The vertical actuator 98 may be such as, by way of non-limiting example, hydraulic, pneumatic or mechanical screw jack, but other actuator types may be useful, as well.

To convert from the second shallow hull position, as illustrated in FIGS. 2 and 5, to the third deep vee hull configuration, as illustrated in FIGS. 3 and 6, the vertical actuator 98 is extended, pivoting the central hull on the pivot hinge 112 and pushing the central hull keel 36 at the rear end of the central hull 16 proximate to the aft end 22 down past the first and second side hull keels 32 and 34, such that the aft end 22 of the vessel forms a single deep vee configuration. The central hull bottom portion 48 and the first and second side hulls 24 and 26 may be slidably interlocked to each other by any commonly known means, such as, by way of non-limiting example, tongue and groove connector slides or the like. A cavity 99 is formed above the top of the central hull bottom portion 48 when the vessel is in the third deep vee configuration. The cavity 99 may be fitted with an expandable bladder as are commonly known which may be filled with water to weigh down the aft end of the vessel, increasing the aft depth and therefore producing a larger wake. In this configuration, the marine vessel 10 will produce a significant amount of wake, which is beneficial for high wake watersports, such as, by way of non-limiting example, wakeboarding or wake surfing.

Turning now to FIG. 7, a fourth or mid-level vee hull configuration is shown. This intermediate position between the second or wide beam shallow hull configuration and the third or wide beam deep vee hull configuration is achieved by extending the vertical actuator 98 only part way. This position maintains a generally trimaran hull shape with central hull keel 36 below the first and second side hull keels 32 and 34, yet not as deep as in the third configuration, as shown in FIG. 6. In this configuration, the marine vessel 10 will produce a moderate amount of wake, while still able to achieve high speeds.

While specific embodiments of the invention have been described and illustrated, such embodiments should be considered illustrative of the invention only and not as limiting the invention as construed in accordance with the accompanying claims.

What is claimed is:

1. A boat hull comprising:

a central hull having top and bottom portions; and first and second side hulls slidably supported from said top portion of said central hull so as to be transversely extendable relative thereto; wherein said bottom portion of said central hull is rotatably connected to said top portion so as to be movable between raised and lowered positions, and wherein said central hull and said first and second side hulls form a continuous wetted running surface thereunder.

2. The boat hull of claim 1 wherein said first and second side hulls are positioned outside said bottom portion of said central hull at said lowered position.

3. The boat hull of claim 1 wherein said bottom portion of said central hull is nested within said first and second side hulls at said raised position.

4. The boat hull of claim 1 further comprising at least one actuator for extending said first and second side hulls relative to said central hull.

5. The boat hull of claim 1 wherein said bottom portion of said central hull is rotatable relative to said top portion about an axis.

6. The boat hull of claim 5 wherein said axis is horizontal.

7. The boat hull of claim 6 wherein said axis is located proximate to a leading edge of said bottom portion.

8. The boat hull of claim 1 wherein said bottom portion has an angular orientation relative to horizontal greater at said lowered position than at said raised position.

9. The boat hull of claim 1 further comprising an actuator for extending said bottom portion between said raised and lowered positions.

10. The boat hull of claim 1 wherein said bottom portion is abuttable against and alignable with said first and second side hulls such that a bottom running surface of said bottom portion is continuous with corresponding bottom running surfaces of said side hulls at said lowered position.

11. The boat hull of claim 1 wherein said bottom portion of said central hull is positionable at an intermediate position between said raised and lowered positions.

12. The boat hull of claim 11 wherein said bottom portion is abuttable against and alignable with said first and second side hulls at said intermediate position so as to form a continuous bottom running surface therebetween.

13. The boat hull of claim 1 further comprising a motor and drive assembly supported on said bottom portion of said central hull.

14. A method of reconfiguring a boat hull comprising:

providing a central hull having top and bottom portions;

providing first and second side hulls slidably supported from said top portion of said central hull so as to be transversely extendable relative thereto; wherein said bottom portion of said central hull is rotatably connected to said top portion so as to be movable between raised and lowered positions, and wherein said central hull and said first and second side hulls form a continuous wetted running surface thereunder.

15. A method of reconfiguring a boat hull comprising:

slidably displacing first and second side hulls relative to a central hull; and rotatably displacing a bottom portion of said central hull relative to a top portion from a raised position to a lowered position between said first and second side hulls, wherein said central hull and said first and second side hulls form a continuous wetted running surface thereunder.

* * * * *